US011147738B1

(12) United States Patent
Nunez et al.

(10) Patent No.: US 11,147,738 B1
(45) Date of Patent: Oct. 19, 2021

(54) PORTABLE SPA

(71) Applicants: Ricardo R. Nunez, Pompton Lakes, NJ (US); Floralba M. Nunez, Pompton Lakes, NJ (US)

(72) Inventors: Ricardo R. Nunez, Pompton Lakes, NJ (US); Floralba M. Nunez, Pompton Lakes, NJ (US)

( * ) Notice: Subject to any disclaimer, the term of this patent is extended or adjusted under 35 U.S.C. 154(b) by 17 days.

(21) Appl. No.: 16/675,872

(22) Filed: Nov. 6, 2019

Related U.S. Application Data

(60) Provisional application No. 62/756,376, filed on Nov. 6, 2018.

(51) Int. Cl.
*A61H 33/06* (2006.01)
*A61H 35/00* (2006.01)
*A61H 33/00* (2006.01)

(52) U.S. Cl.
CPC ..... *A61H 33/067* (2013.01); *A61H 33/065* (2013.01); *A61H 33/066* (2013.01); *A61H 33/6005* (2013.01); *A61H 2033/061* (2013.01); *A61H 2033/068* (2013.01); *A61H 2035/004* (2013.01); *A61H 2201/0157* (2013.01)

(58) Field of Classification Search
CPC .. A61H 33/067; A61H 33/065; A61H 33/066; A61H 2033/061; A61H 2033/068; A61H 2035/004; A61H 2201/0157
See application file for complete search history.

(56) References Cited

U.S. PATENT DOCUMENTS 2,156,993 A * 5/1939 Knoche ..... A61H 33/06 4/532
2,501,194 A * 3/1950 Shumaker ..... A61H 33/06 4/532
2,526,357 A * 10/1950 Hjelm ..... A61H 33/06 4/536
2,725,577 A 12/1955 Howard
3,092,843 A 6/1963 Wright
3,351,957 A 11/1967 Ikeda
3,707,732 A * 1/1973 Cosper ..... A61H 33/06 4/532
4,425,672 A * 1/1984 Johnson ..... A47K 3/006 4/528
4,862,526 A * 9/1989 Berger ..... A61H 33/06 4/536

(Continued)

FOREIGN PATENT DOCUMENTS

GB 2099695 A * 12/1982 ..... A61H 33/06

*Primary Examiner* — Erin Deery
(74) *Attorney, Agent, or Firm* — Cramer Patent & Design PLLC; Aaron R. Cramer

(57) ABSTRACT

A portable spa is particularly suited for use by an individual. The portable spa includes a housing defining an interior having a pair of rear wheels disposed beneath a rear side edge of the base of the housing. A hinged door provides access to the interior while an aperture and circumferential seal is disposed upon an upper surface of the housing. This enables for a portion of the body of a user to be situated above and exterior to the housing. An adjustable seat, control panel, water reservoir, condensate pan, aromatherapy oil reservoir and electrical heating unit are secured within the housing. The spa also comprises an oven limit safety thermostat to prevent overheating. An exterior switch actuates the spa.

19 Claims, 3 Drawing Sheets

(56) References Cited

U.S. PATENT DOCUMENTS

| | | | | |
|---|---|---|---|---|
| 5,441,529 | A * | 8/1995 | Dorsch | A61H 9/00 4/568 |
| 6,170,097 | B1 | 1/2001 | Lin | |
| 6,615,419 | B1 | 9/2003 | Chang | |
| 2009/0019634 | A1 | 1/2009 | Lipponen | |
| 2010/0204760 | A1* | 8/2010 | Lawliss | A61H 33/066 607/83 |
| 2011/0209283 | A1 | 9/2011 | Chen | |
| 2016/0081875 | A1 | 3/2016 | Oh et al. | |

* cited by examiner

PORTABLE SPA

RELATED APPLICATIONS

The present invention is a continuation of, was first described in, and claims the benefit of U.S. Provisional Application No. 62/756,376 filed Nov. 6, 2018 the entire disclosures of which are incorporated herein by reference.

FIELD OF THE INVENTION

The present invention relates generally to a spa and more specifically to a portable spa system.

BACKGROUND OF THE INVENTION

The benefits of heat and steam have been recognized for centuries. The use of saunas in ancient cultures has been well documented, in some cases, as far back as the 30th century B.C. Such usage is understandable in that recent studies have shown that sauna sessions can improve one's immune system, increases circulation and aids in skin condition and appearance. Unfortunately, one must travel to a spa, resort, athletic center, or other similar location to experience such benefits. While one can build a sauna into their home, it is a costly proposition and takes up valuable real estate which could be put to better use in most homes. Utility modification including large electrical feeds, water lines and drain lines are necessary which also drive up costs and complications. Accordingly, there exists a need for a means by which the benefits of a steam sauna can be enjoyed without the disadvantages as described above. The use of the portable spa system allows one to enjoy the health benefits of a sauna in a home environment in a manner which is not only quick, easy, and effective, but cost affordable as well.

SUMMARY OF THE INVENTION

In view of the foregoing references, the inventor recognized the aforementioned inherent problems and observed that there is a need for a portable spa system comprises a steam generating unit producing a steaming spa treatment for a user which resides within an interior of the portable spa system, a generally planar shell which has a generally planar base, a generally planar right sidewall, a generally planar left sidewall, a sloping front wall, and a door, an upper opening which has a rigid rim which is located on the upper perimeter edge of the door and the shell and a skirt which has a first edge that is affixed to the rim and that is bifurcated and a second edge. The second edge of the skirt is bound by an elastic band having a comfortable cover. The door is closed against the shell when the bifurcated ends of the skirt and the bifurcated ends of the elastic band abut each other.

The portable spa system also comprises a mating fastener which attaches these bifurcated ends together to create a continuous skirt about the rim and the upper opening and a condensate tray which extends into the base and is in environmental communication with the interior of the portable spa system. The condensate tray is immediately subjacent to the door. The condensate tray includes a front wall, a right sidewall and a left sidewall continuous with the overall profile of the shell and the door. When the door is shut against the shell, the condensate tray is sized to contain an amount of condensate produced during operation of the steam generating unit and a rear wall of the condensate tray abuts a rear of the base.

The portable spa system also comprises a tray handle which is integrally formed within the front wall of the condensate tray, a grate which is sited superjacent the condensate tray to enable condensate generated during operation from the steam generating unit to pass therethrough and collect in the condensate tray and a control circuit which is located either on the steam generating unit or within the shell of the portable spa system when the steam generating unit is fully inserted into a bottom opening and the control circuit is within the shell. The portable spa system also comprises a window enabling the user to view a volume remaining in the reservoir located on at least one sidewall of the steam generating unit. The steam generating unit is sized to have minimal clearance between the open top and the bottom surface of the foot support when the steam generating unit is fully inserted into the bottom opening and a pair of legs which are located on the external side of the rear wall of the shell, which are selectively deployed when the portable spa system is located at a desired position and in use. The pair of legs provide additional secure support from inadvertent movement.

When the user is sitting within the interior of the portable spa system and the steaming spa treatment may reach a midriff of the user or may reach a neck of the user. The steam generating unit may be a five-sided box with an open top having an upper portion which is formed as a reservoir capable of receiving a volume of liquid therein. The door may be attached to a side of the shell with a hinge and the door is large enough to permit the user ingress to and egress from the interior. The door may be shut against the shell when it defines the interior, which is sized so as to permit the user to reside therein. The door may be shut against the shell when, the front wall tapers from a minimal width opening at an upper section of the shell to a maximal width when the front bottom edge of the door meets the front upper edge of the base.

The portable spa system may further comprise a plurality of corners of the portable spa are rounded so as to not snag clothing or the user. The rim may be bifurcated and may be formed as a continuous feature when the door is shut against the shell. The rim may include a soft and non-marring cover to protect the user. The skirt may be made of a flexible plastic or a flexible fabric. The condensate tray may provide a positive seal for the interior from the environment. A plurality of unlocking wheels may provide additional secure support from inadvertent movement.

The portable spa system may further comprise an additive door having an additive door handle that is located and hingedly attached at the leading front edge of the foot support to enable the user to add more liquid within the subjacent reservoir, essential oils, or other additives while residing within the interior. The portable spa system may further comprise a shell handle which is located at a central upper location on the outer surface of the rear panel of the shell to aid in manipulating the portable spa system to a desired location. The portable spa system may further comprise a door interlock switch which may be operably controlled by the door when firmly seated against the shell. The switch is in electrical communication with the control circuit to cease operation of the steam generating unit. A thermostat may be affixed or embedded within a sidewall of the shell and in electrical communication with the control circuit for controlling the temperature of the resistive-type heating element, and therefor the amount of steam produced. A power cord may provide electrical communication between the steam generating unit and a power source. A ground fault circuit interrupter may be wired in-line with the power cord that is re-set when tripped, when plugged into an unprotected electrical socket.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
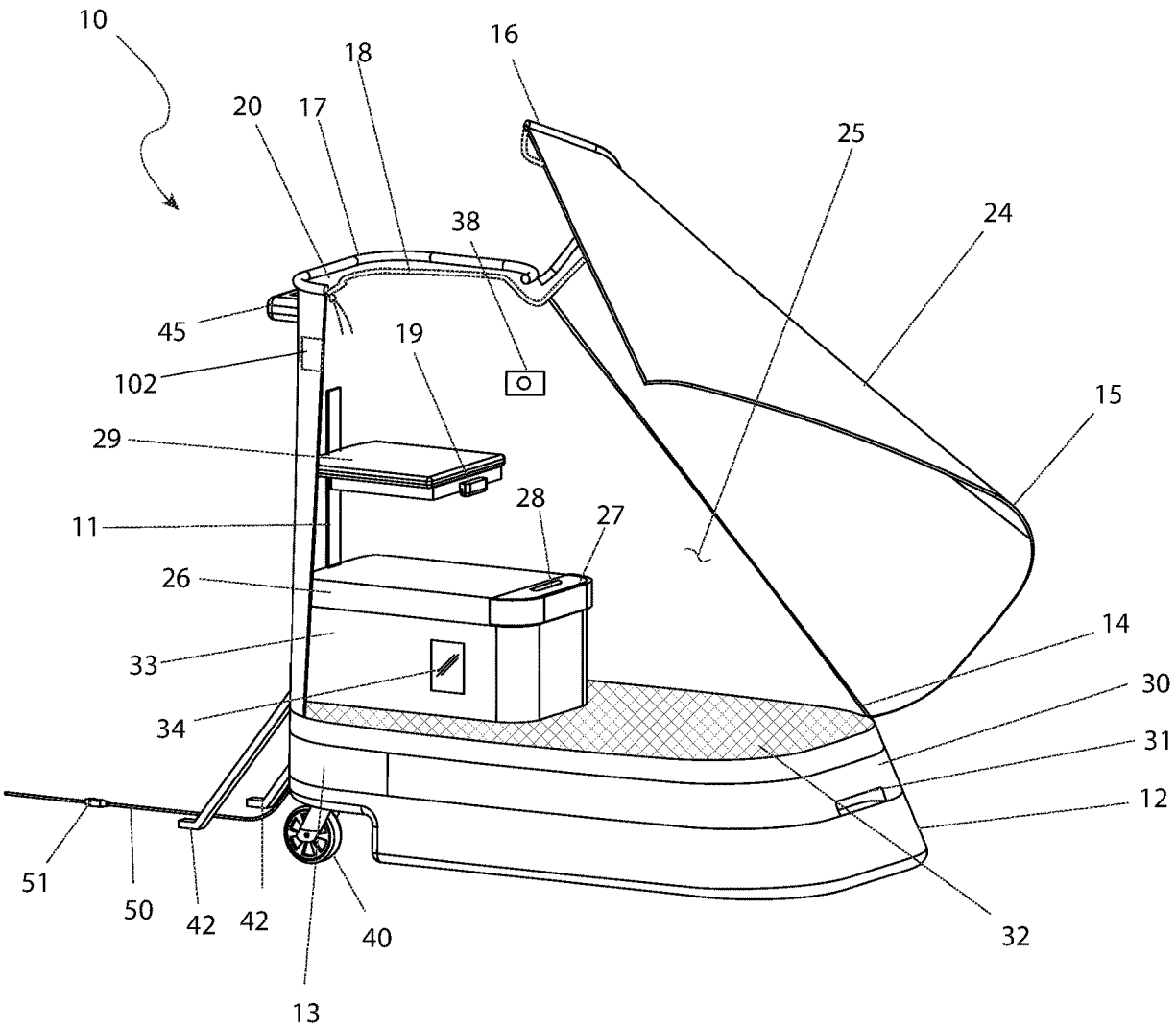
FIG. 1 is a side perspective view of a portable spa system 10, according to the preferred embodiment of the present invention.

10 portable spa system
11 seat track
12 base bottom
13 base rear
14 hinge
15 door
16 door rim
17 rim
18 elastic band
19 seat release
20 skirt
24 shell
25 interior
26 foot support
27 additive door
28 additive door handle
29 seat
30 condensate tray
31 tray handle
32 grate
33 steam generating unit
34 window
38 thermostat
40 wheel
42 leg
45 shell handle
50 power cord
51 ground fault circuit interrupter
100 alternate portable spa system
102 door interlock switch
104 electrical heating coils
111 alternate seat track
112 alternate base
113 alternate rear
114 alternate hinge
115 alternate door
116 alternate door rim
117 alternate rim
118 alternate elastic band
119 alternate seat release
120 alternate skirt
124 alternate shell
125 alternate interior
126 alternate foot support
127 alternate additive door
128 alternate additive door handle
129 alternate seat
130 alternate condensate tray
131 alternate tray handle
132 alternate grate
133 alternate steam generating unit
134 alternate window
138 alternate thermostat
140 alternate wheel
142 alternate leg
145 alternate shell handle
150 alternate power cord
151 ground fault circuit interrupter

DESCRIPTION OF THE INVENTION

Figure 2:
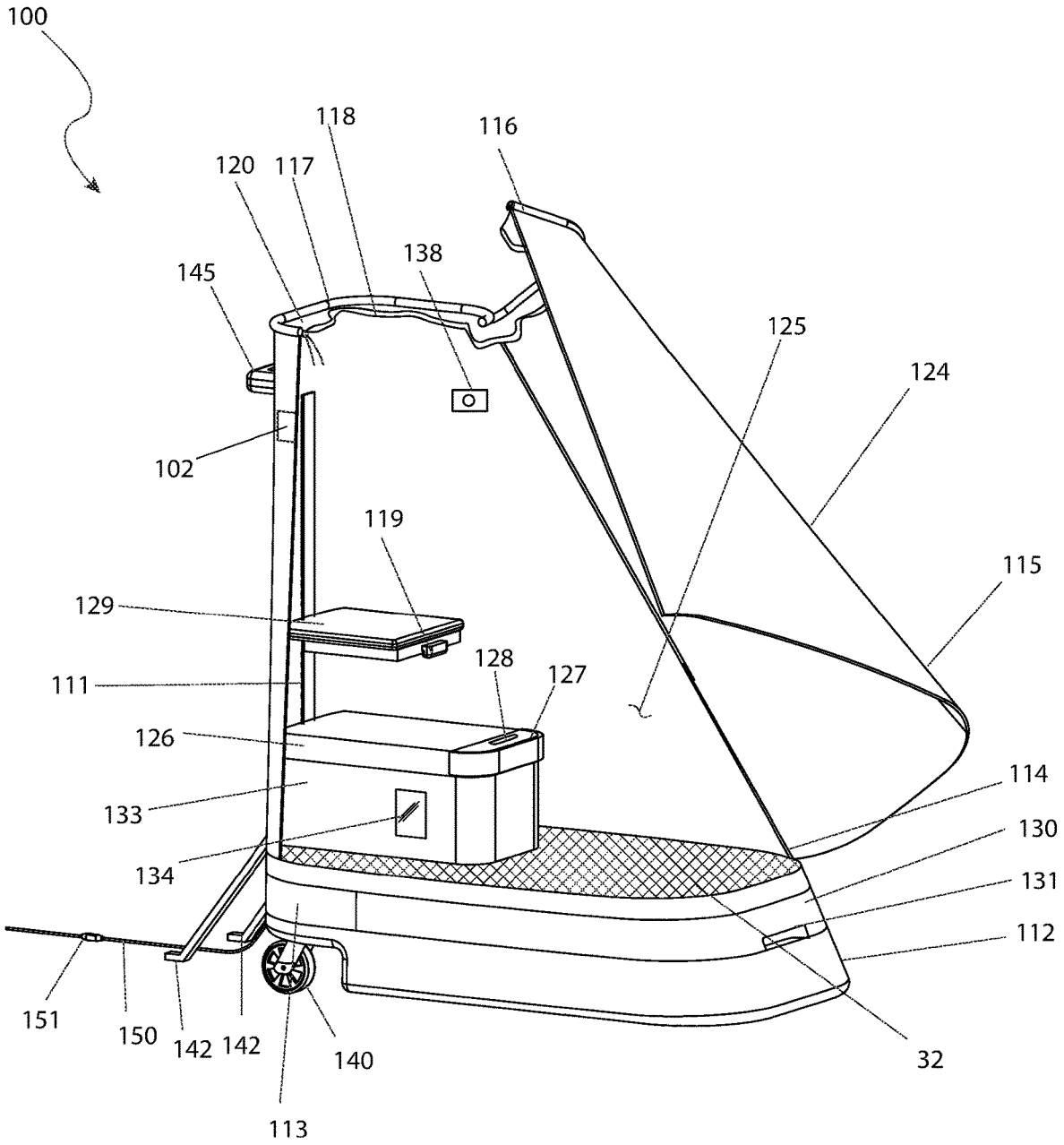
FIG. 2 is a side perspective view of an alternate portable spa system 100, according to an alternate embodiment of the present invention; and, FIG. 3 is an electrical block diagram depicting the major electrical components of both the preferred and alternate embodiments of the present invention.
Figure 3:
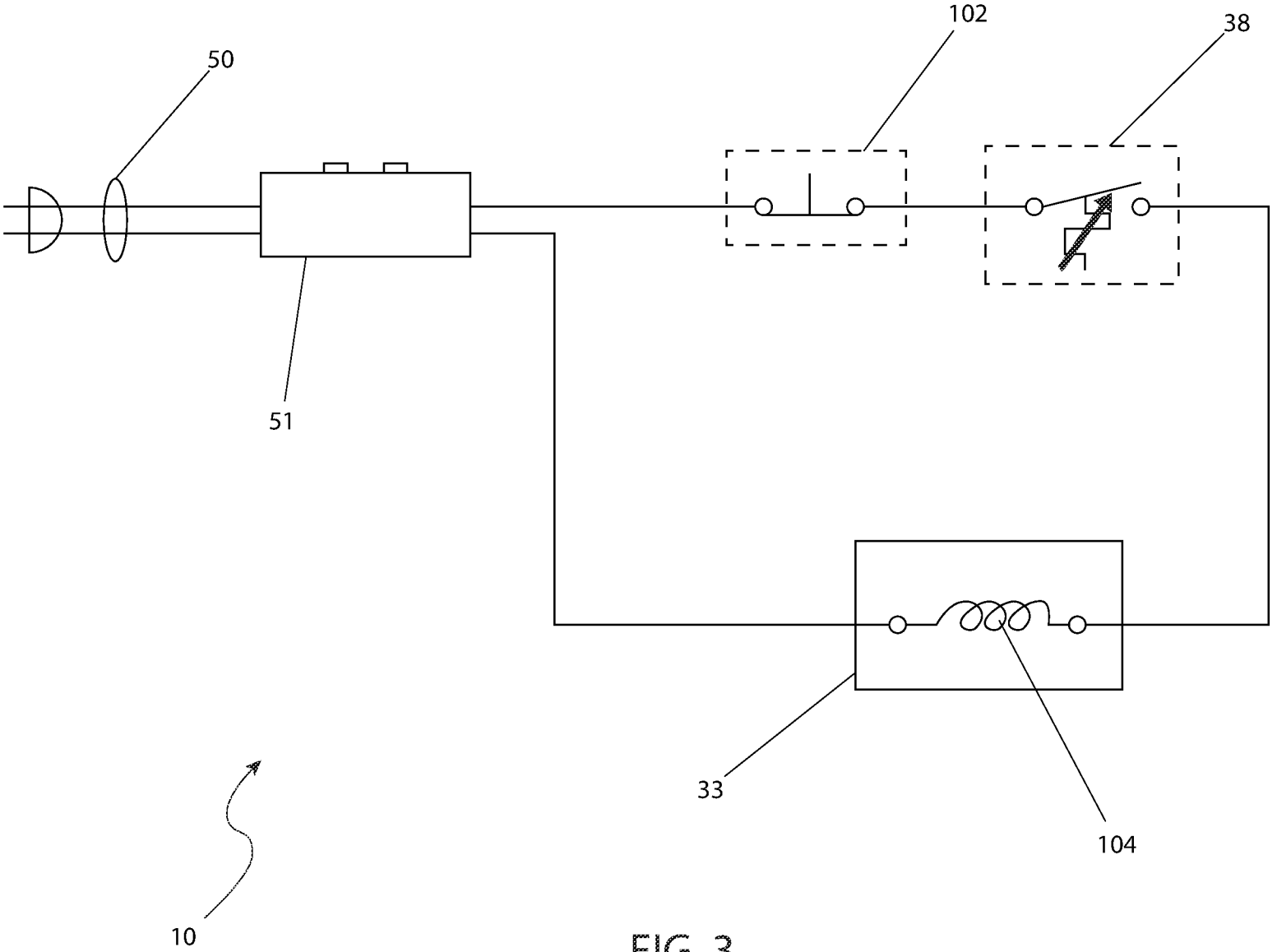

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Both FIGS. 1 and 2 illustrate side perspective views of a portable spa system 10 and an alternate portable spa system 100, respectively. Each system 10, 100 is intended to be used as a portable personal hygiene station. The spa system 10, 100 is configured to have a user reside within the interior 25, 125 and experience a steaming spa treatment by the actions of steam generating unit 33, 133. FIG. 1 illustrates a first and preferred embodiment 10, where a user sits inside the interior 25 and the overall height reaches the midriff of the user. FIG. 2 illustrates an alternate embodiment 100, wherein the overall height reaches the neck of the user. The features of each embodiment 10, 100 are nearly identical in size, shape, and functionality, except that the shell 24 and door 15 of the first embodiment 10 is shorter in height than the alternate shell 124 and alternate door 115 of the alternate embodiment 100.

Referring more closely to the first embodiment 10, which illustrates a shell 24 with a door 15 attached to a side of the shell 24 with a hinge 14. When the door 15 is shut, the outer profile of the door 15 and shell 24 is continuous. The overall shape of the shell 24 and door 15 combination is a generally planar rear wall (which is envisioned to be part of the shell 24), a generally planar base 12 (also envisioned to be part of the shell 24), a generally planar right sidewall (also envisioned to be part of the shell 24), a generally planar left sidewall (a majority of which is envisioned to be part of the door 15), and a sloping front wall (also envisioned to be part of the door 15). All corners are envisioned to be gently rounded so as to not snag clothing or the user. When the door 15 is shut against the shell 24, the front wall tapers from a minimal width opening at the upper section to a maximal width when the front bottom edge of the door 15 meets the front upper edge of the base 12. When the door 15 is shut against the shell 24, it defines the interior 25, which is sized so as to permit the user to reside therein. The door 15 is also large enough to permit the user ingress to and egress from the interior 25.

The upper opening has a rigid rim 17 located on the upper perimeter edge of the door 15 and the shell 24. The rim 17 is bifurcated and is formed as a continuous feature when the door 15 is shut against the shell 24. The rim 17 can have a soft and non-marring cover to protect the user A skirt 20 has a first edge that is affixed to the rim 17 and is also bifurcated in the same manner as the rim 17. The second edge of the skirt 20 is bound by an elastic band 18, preferably having a comfortable cover. The skirt 20 is a flexible plastic or fabric material. When the door 15 is closed against the shell 24, the bifurcated ends of the skirt 20 and the bifurcated ends of the elastic band abut each other. A mating fastener can then attach these bifurcated ends together to create a continuous skirt 20 about the rim 17 and the upper opening. The elastic band 18 can then have a drawstring and a keeper to facilitate the user to diminish or expand the diameter of the skirt 20. It is envisioned that the skirt 20 and elastic band 18 provides a generally steamproof and/or waterproof seal against the user such that steam cannot escape from the interior 25 to the environment.

Immediately subjacent the door 15 is a condensate tray 30 extending into the base and in environmental communication with the interior 25 of the system 10. The condensate tray 30 has a front wall, a right sidewall and a left sidewall continuous with the overall profile of the shell 24 and door 15, when the door 15 is shut against the shell 24. The condensate tray 30 also has a rear wall. The condensate tray 30 is sized to contain an amount of condensate produced during operation of the steam generating unit 33. The condensate tray 30 has dimensions not as deep as the overall dimensions as the right and left sidewalls of the shell 24. The rear wall of the condensate tray 30 abuts the base rear 13. A tray handle 31 is integrally formed within the font wall of the condensate tray 30. It is preferred that the condensate tray 30 is supported on the base bottom 12 via a track and rail or a pair of tracks and a pair of rails. Alternately, the condensate tray 30 can be supported on similar hardware located on inner surfaces of the right and left sidewalls. An outwardly pulling force on the condensate tray 30 from the front of the system 10 pulls the condensate tray 30 away from the base 12. The condensate tray 30 is preferably capable of full removal from the base 12 for cleaning and emptying. When fully seated in the system 10, the condensate tray 30 provides a positive seal for the interior 25 from the environment.

The bottom front edge of the base bottom 12 also has a continuous front wall with the same slope profile as the front wall of the door 15 and the front wall of the condensate tray 30, and the same continuous profile as the right and left sidewalls of the shell 24, door 15, and condensate tray 30. In some embodiments, the base bottom 12 and base rear 13 are a unitary construction. The bottom surface of the base bottom 12 has a rear notch along the width, or a pair of notches in the corners, to enable mounting of wheels 40, which can be caster or other types of wheels.

Within the interior 25 of the system 10 is a seat 29, a foot support 26, a removable steam generating unit 33, a thermostat 38, and a condensate tray 30. A grate 32 is formed or sited immediately superjacent the condensate tray 30 and enables condensate generated during operation from the steam generating unit 33 to pass therethrough and collect in the condensate tray 30. The seat 29 is vertically adjustable along a seat track 11, which is attached to a center location on an inner surface (i.e., within the interior 25) of the rear wall of the shell 24, terminating at a distance subjacent the upper opening and either integral with or attached at a lower end to the foot support 26. The seat 29 includes a seat release 19 that provides a way to vertically position the seat 29 at a desired location along the seat track 11. Such a seat release 19 can be a positive displacement pin into one (1) of a plurality of equidistantly-spaced apertures along the seat track 11. As mentioned above, the foot support 26 is located immediately subjacent from the lower end of the seat track 11 and is attached at a rear portion to the inner surface of the rear wall. The width and depth of the foot support 26 is approximately identical to that of the width and depth of the seat 29.

The rear wall has a bottom opening located immediately above the grate 32, immediately below the foot support 26, and covered by an access panel. The bottom opening is sized to enable passage of the steam generating unit 33 therein. A control circuit is located either on the steam generating unit 33 or within the shell 24 of the system. When the steam generating unit 33 is fully inserted into the bottom opening and in the embodiment where the control circuit is within the shell 24, there is a means to provide electrical communication therebetween. It is preferred that a proper positioning of the steam generating unit 33 is that the bottom rests directly on the grate 32, the rear wall is flush with the outer surface of the rear wall of the shell 24, the upper end has a minimal clearance with the bottom surface of the foot support 26, and any electrical communications are achieved when properly positioned. The steam generating unit 33 is envisioned to be a five-sided box with an open top, having an upper portion formed as a reservoir capable of receiving a volume of liquid, preferably water, therein. There may or not be baffles in the reservoir to minimize wave-like motion of the liquid during insertion or movement thereof. The bottom portion under the reservoir has a standard resistive-type heating element that selectively heats the liquid (in the case of the liquid being water, to generate steam) in order to enable the vapors of the liquid to emanate out of the open top, through multiple apertures on plate covering the open top, or emanate out of another port located on the outer wall of the reservoir section.

Located on at least one (1) sidewall of the steam generating unit 33 is a window 34 enabling the user to view the volume remaining in the reservoir. The steam generating unit 33 is sized to have minimal clearance between the open top and the bottom surface of the foot support 26 when the steam generating unit 33 is fully inserted into the bottom opening. The steam generating unit 33 is designed to be easily inserted and removed as necessary for quick filling, maintenance, or replacement. A power cord 50 can provide electrical communication between the steam generating unit 33 and a power source. Located and hingedly attached at the leading front edge of the foot support 26 is an additive door 27 with an additive door handle 28. This enables the user to add more liquid within the subjacent reservoir, essential oils, or other additives while residing within the interior 25.

Located on the external side of the rear wall of the shell 24 are a pair of legs 42, which can be selectively deploys when the system 10 is located at a desired position and in use. The legs 42 provide additional secure support from inadvertent movement. Other features to provide such unwanted movement can be locking wheels 42. A shell handle 45 is located at a central upper location on the outer surface of the rear panel of the shell 24 to aid in manipulating the system 10 to a desired location.

Other features envisioned for each embodiment 10, 100 include a door interlock switch 102 operably controlled by when the door 15 firmly seats against the shell 24. Such a switch is in electrical communication with the onboard control circuit to cease operation of the steam generating unit 33. A thermostat 38 can be affixed or embedded within a sidewall of the shell 24 and in electrical communication with the onboard control circuit for controlling the temperature of the resistive-type heating element, and therefor the amount of steam produces (when the liquid in the reservoir is water). Yet another feature can be a ground fault circuit interrupter 51 wired in-line with the power cord 50, that can be re-set when tripped, such as when plugged into an unprotected electrical socket.

As mentioned above, the alternate embodiment 100 is identical in nearly every way from the preferred embodiment 10 except for the overall height.

Referring now to FIG. 3, an electrical block diagram depicting the major electrical components of both the preferred and alternate embodiments of the present invention is shown. Electrical power, provided by the power cord 50, is routed through the 30 cord mounted ground fault interrupter 51. The purpose of the ground fault interrupter 51 is to prevent fatal electrical shocks while using the portable spa system 10. Electrical power is then routed through the door interlock switch 102 and the thermostat 38 wired in a series manner. The resultant power is then delivered to electrical heating coils 104 inside of the steam generating unit 33 to complete the electrical circuit. Should the door 15 (as shown in FIG. 1) or the alternate door 115 (as shown in FIG. 2) be opened, the circuit will be opened and power to the electrical heating coils 104 interrupted. Likewise, should the internal temperature of the interior of the portable spa system 10 reach above the setpoint as desired by the user, the thermostat 38 will open and also interrupt power the electrical heating coils 104.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A portable spa system, comprising:

a steam generating unit adapted to produce a steaming spa treatment for a user residing within an interior of the portable spa system;

a planar shell having a planar base and a planar right sidewall;

a door having a planar left sidewall and a sloping front wall;

an upper opening having a rigid rim located on an upper perimeter edge of the door and the shell;

a skirt having a first edge that is affixed to the rim and a second edge, the skirt is bifurcated, the second edge of the skirt is bound by an elastic band having a cover, the door is closed against the shell when a plurality of bifurcated ends of the skirt and a plurality of bifurcated ends of the elastic band abut each other;

a mating fastener attaching the bifurcated ends of the skirt and the elastic band together to create a continuous skirt about the rim and the upper opening;

a condensate tray extending into the base and in environmental communication with the interior of the portable spa system, the condensate tray includes a front wall, a right sidewall and a left sidewall continuous with the overall profile of the shell and the door when the door is shut against the shell, the condensate tray is sized to contain an amount of condensate produced during operation of the steam generating unit and a rear wall of the condensate tray abuts a rear of the base when the door is shut against the shell;

a tray handle integrally formed within the front wall of the condensate tray;

a grate seated superjacent to the condensate tray to enable condensate generated during operation from the steam generating unit to pass therethrough and collect in the condensate tray;

a control circuit is located either on the steam generating unit or within the shell, when the steam generating unit is fully inserted into a bottom opening of a rear wall of the shell and the control circuit is within the shell;

a window adapted to enable the user to view a volume remaining in a reservoir of the steam generating unit, the window located on at least one sidewall of the steam generating unit, the steam generating unit is sized to have clearance between an open top of the reservoir and a bottom surface of a foot support when the steam generating unit is fully inserted into the bottom opening; and a pair of legs located on an external side of the rear wall of the shell, which are selectively deployed when the portable spa system is located at a desired position and in use, the pair of legs provide additional secure support from inadvertent movement.

2. The portable spa system according to claim 1, wherein the user is sitting within the interior of the portable spa system and the steaming spa treatment is adapted to reach a midriff of the user.

3. The portable spa system according to claim 1, wherein the user is sitting within the interior of the portable spa system and the steaming spa treatment is adapted to reach a neck of the user.

4. The portable spa system according to claim 1, wherein the door is attached to a side of the shell with a hinge and the door is large enough to be adapted to permit the user ingress to and egress from the interior of the portable spa system.

5. The portable spa system according to claim 1, wherein the door is shut against the shell when it defines the interior of the portable spa system, which is sized so as to be adapted to permit the user to reside therein.

6. The portable spa system according to claim 1, wherein the door is shut against the shell when, the front wall tapers from a minimal width opening at an upper section of the shell to a maximal width when a front bottom edge of the door meets a front upper edge of the grate.

7. The portable spa system according to claim 1, further comprising a plurality of corners of the portable spa are rounded to prevent clothing or the user from snagging.

8. The portable spa system according to claim 1, wherein the rim is bifurcated and is formed as a continuous feature when the door is shut against the shell.

9. The portable spa system according to claim 1, wherein the rim includes a cover that is adapted to protect the user.

10. The portable spa system according to claim 1, wherein the skirt is made of a flexible plastic.

11. The portable spa system according to claim 1, wherein the skirt is made of a flexible fabric.

12. The portable spa system according to claim 1, wherein the condensate tray provides a positive seal for the interior of the portable spa system from an exterior environment.

13. The portable spa system according to claim 1, wherein a plurality of unlocking wheels provides additional secure support from inadvertent movement.

14. The portable spa system according to claim 1, further comprising an additive door having an additive door handle that is located and hingedly attached at a leading front edge of the foot support that is adapted to enable the user to add more liquid within the reservoir, essential oils, or other additives while residing within the interior of the portable spa system.

15. The portable spa system according to claim 1, further comprising a shell handle located at a central upper location on the external side of the rear wall of the shell to aid in manipulating the portable spa system to a desired location.

16. The portable spa system according to claim 1, further comprising a door interlock switch operably controlled by the door when firmly seated against the shell, the switch is in electrical communication with the control circuit to cease operation of the steam generating unit.

17. The portable spa system according to claim 1, further comprising a thermostat affixed or embedded within one of the right sidewall or left sidewall and in electrical communication with the control circuit for controlling the temperature of a resistive-type heating element and an amount of steam produced.

18. The portable spa system according to claim 1, further comprising a power cord providing electrical communication between the steam generating unit and a power source.

19. The portable spa system according to claim 18, further comprising a ground fault circuit interrupter wired in-line with the power cord that is re-set when tripped, when plugged into an unprotected electrical socket.

* * * * *